United States Patent [19]

Hoët et al.

[11] Patent Number: 4,644,217

[45] Date of Patent: Feb. 17, 1987

[54] ELECTRON TUBE WITH A DEVICE FOR COOLING THE GRID BASE

[75] Inventors: Roger Hoët; Pierre Gerlach, both of Thonon Les Bains, France

[73] Assignee: Thomson-CSF, Paris, France

[21] Appl. No.: 731,553

[22] Filed: May 7, 1985

[30] Foreign Application Priority Data

May 9, 1984 [FR] France ..... 84 07105

[51] Int. Cl.[4] ..... H01J 7/26

[52] U.S. Cl. ..... 313/35; 313/39

[58] Field of Search ..... 313/35, 32, 39, 11, 313/12; 378/141

[56] References Cited

U.S. PATENT DOCUMENTS

| | | | |
|---|---|---|---|
| 2,790,102 | 4/1957 | Atlee | 313/32 |
| 3,309,556 | 3/1967 | Lien | 313/32 |
| 3,646,380 | 2/1972 | Hartl | 313/35 |
| 3,805,111 | 4/1974 | Ryabinin et al. | 315/39.51 |
| 3,866,085 | 2/1975 | James | 313/25 |

*Primary Examiner*—Michael J. Tokar
*Assistant Examiner*—Hezron E. Williams
*Attorney, Agent, or Firm*—Roland Plottel

[57] ABSTRACT

In an electron tube with coaxial electrodes comprising an anode, a cathode and at least one grid, the base of each electrode being connected to the outside through a connection, there is mounted between the base of the grid and said connection a solid annular piece having a duct for the passage of a cooling fluid, said duct being connected to at least one fluid inlet tube and one fluid outlet tube.

4 Claims, 2 Drawing Figures

ELECTRON TUBE WITH A DEVICE FOR COOLING THE GRID BASE

BACKGROUND OF THE INVENTION

1. Field of the invention

The present invention relates to an improvement to electron tubes, more especially to power electron tubes operating at frequencies of the order of a few hundred megahertz.

The present invention relates more particularly to a means for internally cooling the base of some electrodes of the tube.

2. Description of the prior art

As shown schematically in FIG. 1 which relates to a power tetrode, the electron tubes to which the present invention applies are vacuum tubes formed essentially by coaxial cylindrical electrodes comprising an anode 1, a screen grid 2 called grid $G_2$, a control grid 3 called grid $G_1$ and a cathode 4.

These different electrodes are connected to the outside of the tube through circular metal connections 5, 6, 7, 8 separated from each other by insulators 9, 10, 11, 12 preferably made from a ceramic material and further providing sealing of the tube. These metal connections 5, 6, 7, 8 are generally formed by pieces stamped in the shape of cups and are brazed to the insulators.

The metal connections are connected to different voltage sources not shown and serve respectively for the passage of the current for heating the cathode and the circulation of high frequency currents.

However, heating of the cathode and circulation of the high frequency currents are heat generators and this heat is removed by conduction towards the metal connections.

Usually, the connections are cooled by injecting compressed air on the head of the tube. In most cases, this cooling is sufficient for maintaining the connections and the brazing of these connections to the insulators at a sufficiently low temperature which does not damage them.

However, the ultra high frequency operation of this type of tube gives rise to a sinusoidal distribution of the surface electric currents. Consequently, some zones of these surfaces which correspond to a current "antinode" where the intensity is maximum are subjected to intense local heating.

In some cases of operation, these current antinodes are situated at the level of the connections. Consequently, French patent application No. 81 21804 has proposed a cooling system outside the tube formed by a spiral shaped tube through which a cooling fluid flows and in engagement, preferably by welding, with the connection of the electrode to be cooled.

With this cooling system, a considerable amount of heat is eliminated, in particular in the vicinity of a current "antinode".

However, the heating zones due to current "antinodes" located inside the tube are not cooled. Now, in some cases, the heating is such that it brings the metal parts up to a high temperature, resistance to the passage of the current increasing the temperature. Thus, the increase in temperature may be such that the vapor tensions of the metals from which the electrodes are formed are reached. In this case, there is an emission of gas which causes at least a local deterioration of the vacuum and renders the tube unserviceable.

Furthermore, in power electron tubes of known type, the hear generated at the grids, and more particularly at the control grid $G_1$, by the current "antinodes" can only be removed by radiation from the envelope of the tube or by conduction through the output connection. Now, the connections are generally made from an iron-nickel-cobalt alloy of small thickness for readily brazing them to the contiguous ceramic material insulators. Now, iron-nickel-cobalt alloy is a poor heat conductor. Moreover, the connections have small thicknesses. The result is therefore very limited removal of the heat.

SUMMARY OF THE INVENTION

The aim of the present invention is to overcome the above disadvantages by providing a cooling system internal to the tube for removing most of the heat generated at the grids and particularly at the control grid.

Consequently, the present invention provides an electron tube with coaxial electrodes comprising an anode, a cathode and at least one grid, the base of each electrode being connected to the outside through a connection, further comprising at least a fluid flow cooling means mounted between the base of the grid and the corresponding connection for cooling the junction line between said grid and its connection.

In a preferred embodiment, the cooling means is formed by a solid annular piece having around its periphery a duct for the passage of the fluid, said duct being connected to at least one inlet tube and one outlet tube for the cooling fluid.

Furthermore, in order to accomodate the differences in expansion between the solid piece and the connection, said solid piece is extended by an annular lip provided with slits.

BRIEF DESCRIPTION OF THE DRAWINGS

Other features and advantages of the present invention will be clear from reading the description of an embodiment with reference to the accompanying drawings in which.

In the Figures, the same references designate the same elements.

DESCRIPTION OF THE PREFERRED EMBODIMENT

Figure 1:
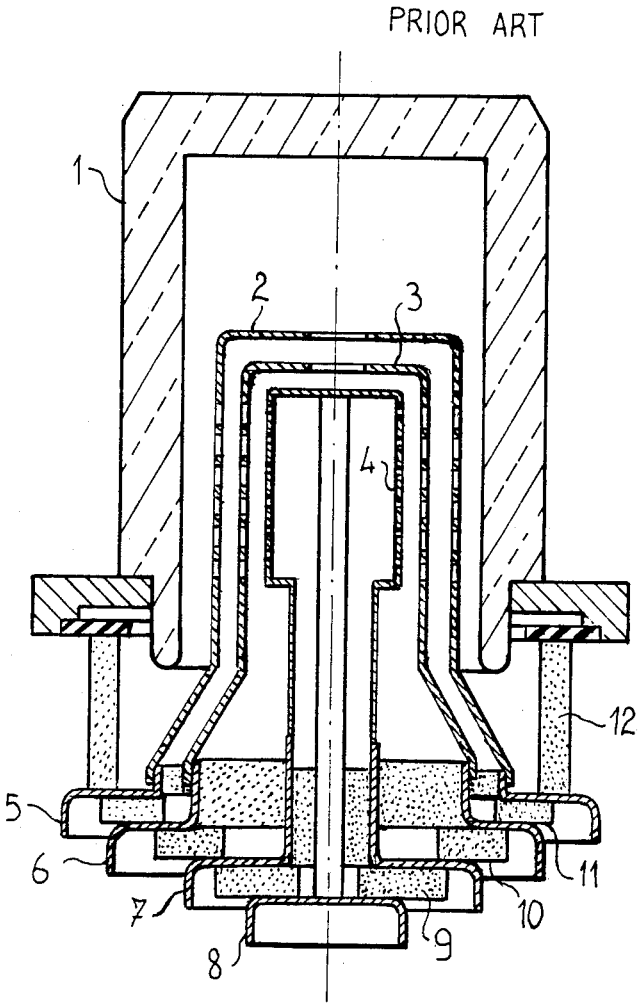
FIG. 1, already described, is a schematical sectional view of an electron tube to which the invention applies.
Figure 2:
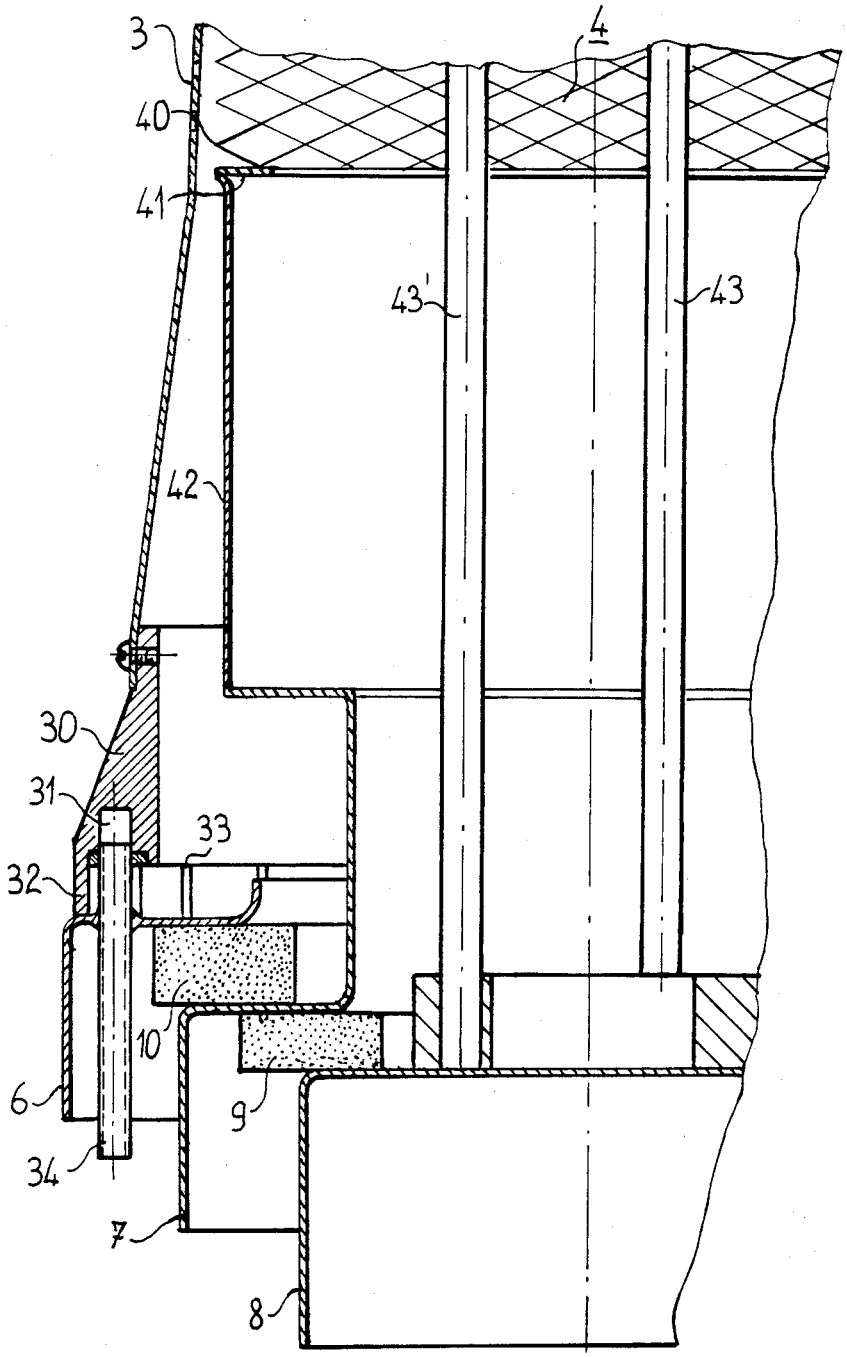
FIG. 2 is an enlarged sectional view of a half of the base of an electron tube equipped with a cooling means in accordance with the present invention.

In the embodiment shown in FIG. 2, cathode 4 comprises a cylindrical sleeve 40 formed in a way known per se by a network of crossed wires made for example from tungsten which may be coated or not with thorium. The two ends of the sleeve are fixed respectively to two metal plates, only the lower metal plate 41 being shown.

The lower plate is connected by a cylindrical skirt 42 made for example from tantalum or molybdenum to the metal connection 7. Moreover, the upper plate is connected by rods 43, 43' to the connection 8. The potential difference applied between connections 7 and 8 ensures that the cathode is brought up to and kept at its working temperature.

In a way known per se, cathode 4 is surrounded by a control grid 3, called grid $G_1$, made for example from metal or from pyrolytic graphite.

In accordance with the invention, this grid 3 is connected to its output connection 6 by a solid annular piece 30.

This annular piece 30 has a triangular shape in section and is provided, at its base, all around its periphery with an internal duct 31 for receiving the cooling fluid.

The cooling fluid is fed into and removed from duct 31 through at least one inlet tube 34 and one outlet tube for the fluid not shown. These two tubes made for example from nickel or from copper may be positioned side by side or symmetrically with respect to the axis of the tube. In all cases, the tubes pass through the connection 6 to which they are brazed.

The solid piece is made from metal, preferably copper. In a preferred embodiment, it is extended on its base side by an annular lip 32 having slits 33 for accomodating the differences in expansion between the metal of connection 6, preferably an iron-nickel-cobalt alloy, and the copper.

As shown in FIG. 2, grid 3 is fixed to the thinner portion of piece 30 by screws 35 whereas lip 32 is fixed to connection 6 by brazing.

Moreover, the different connections 6, 7, 8 are brazed to ceramic insulators 9, 10.

With the above described cooling means, the grid-connection junction is cooled, which removes the heat created at this level by the current "antinodes" which occur at this position during operation. Thus an improvement is obtained in the performance of the electron tube.

The present invention has been described with reference to the control grid. However, it is obvious to a man skilled in the art that an identical cooling means may be used between the screen grid and its connection or between any other grid and its connection although in this case there is less heat to be removed.

In addition, the present invention may be used in all power electron tubes such as triodes, tetrodes or pentodes, requiring considerable cooling.

We claim:

1. An electron tube comprising coaxial electrodes including an anode, a cathode, and at least a control grid having a base portion, means forming with said electrodes a tube envelope, a separate electrical connection for each electrode extending outside the tube envelope, and means inside the tube envelope for interconnecting the base portion of the control grid and its electrical connection and including means for circulating cooling fluid therethrough for cooling the junction between the base of the control grid and its electrical connection.

2. The electron tube as claimed in claim 1, wherein said cooling means is formed by a solid annular piece provided with a duct for the passage of said cooling fluid, said duct being connected to at least one fluid inlet tube and one fluid outlet tube.

3. The electron tube as claimed in claim 2, wherein said solid annular piece is made from copper.

4. The electron tube as claimed in claim 2, wherein said solid piece is extended by an annular lip having slits for accomodating the difference in expansion between said solid piece and said connection.

* * * * *